US007565970B1

(12) United States Patent
Erskine

(10) Patent No.: US 7,565,970 B1
(45) Date of Patent: Jul. 28, 2009

(54) DRUMSTICKS SUPPORT BAG

(75) Inventor: Peter Erskine, Santa Monica, CA (US)

(73) Assignee: Drum Workshop, Inc., Oxnard, CA (US)

( * ) Notice: Subject to any disclaimer, the term of this patent is extended or adjusted under 35 U.S.C. 154(b) by 241 days.

(21) Appl. No.: 11/645,346

(22) Filed: Dec. 26, 2006

(51) Int. Cl.
*A45C 11/00* (2006.01)
*B65D 79/00* (2006.01)
*B65D 5/50* (2006.01)
*A45F 3/00* (2006.01)

(52) U.S. Cl. ..... 206/314; 206/751; 206/756; 206/759; 190/11

(58) Field of Classification Search ..... 206/314; 190/16, 17, 107, 110; 248/163.1, 165, 166, 248/188.6, 188.7, 460, 461, 170, 171
See application file for complete search history.

(56) References Cited

U.S. PATENT DOCUMENTS 3,298,478 A * 1/1967 Soprani ..... 190/11
3,315,621 A * 4/1967 Szymber ..... 108/34
3,326,337 A * 6/1967 Bell ..... 190/11
4,049,091 A * 9/1977 Chubb ..... 190/18 R
4,412,604 A * 11/1983 Bell et al. ..... 190/1
4,790,416 A * 12/1988 Baker ..... 190/11
4,856,627 A * 8/1989 Polatov ..... 190/11
4,986,395 A * 1/1991 Lewis ..... 190/1
6,036,011 A * 3/2000 DeCurtis et al. ..... 206/320
6,068,355 A * 5/2000 Thorp ..... 312/241
6,311,944 B1 * 11/2001 McKsymick et al. ..... 248/461
6,462,260 B2 * 10/2002 Fediakov ..... 84/327
6,811,006 B1 * 11/2004 Mundle ..... 190/11
6,959,810 B2 * 11/2005 Neilson ..... 206/314
7,327,562 B2 * 2/2008 Littlepage ..... 361/683
2002/0023811 A1 * 2/2002 Silvano ..... 190/11
2002/0063072 A1 * 5/2002 Pham ..... 206/320
2008/0149802 A1 * 6/2008 Chiang ..... 248/461

* cited by examiner

*Primary Examiner*—Jila M Mohandesi
*Assistant Examiner*—Jose S Stephens, III
(74) *Attorney, Agent, or Firm*—William W. Haefliger

(57) ABSTRACT

An assembly for transporting and displaying multiple drumsticks for access, comprising, in combination an enclosure for transport of drumsticks and a stand, structure attached to the enclosure having collapsed position relative to the enclosure, for transport, the structure having an alternative deployed position in which the stand can be attached to said structure in upright supported position, there being a generally horizontal tray associated with said structure in said deployed position, and drumsticks removed from the enclosure and displayed on the tray for selective use by a drummer.

12 Claims, 6 Drawing Sheets

DRUMSTICKS SUPPORT BAG

BACKGROUND OF THE INVENTION

This invention relates generally to percussion instruments transport and use, and more particularly to apparatus for transporting and deploying drumsticks at drum use sites such as band performances.

There is a perceived need for ease of rapid selection and use of multiple drumsticks as during band or orchestral performances. While drumsticks can be carried in pockets on supports, their quick retrieval is not easy. Also, tables to support drumsticks are not readily adjustable in height to suit a seated drummer, and are not readily transported to different performance locations.

SUMMARY OF THE INVENTION

It is a major object of the invention to provide method and means to overcome the above problems and disadvantages. Basically, the invention is embodied in a collapsible assembly for transporting and displaying multiple drumsticks for access, comprising, in combination:

a) an enclosure for transport of drumsticks and a stand, b) structure attached to the enclosure having collapsed position relative to the enclosure, for transport, c) that structure having an alternative deployed position in which the stand can be attached to the structure in upright supported position, d) there being a generally horizontal tray associated with said structure in said deployed position, e) the tray configured to support multiple drumsticks for selective use by a drummer.

As will be seen, the stand may be attached to said structure via a structural support spaced below the level of the tray, in deployed position. Also, the tray and structural support extend or are spaced from the opened enclosure, which may be of luggage type.

Another object is to provide a foldable first brace operatively connected to the structural support and the tray, and extending diagonally in space below the tray. The first brace may comprise hingedly connected panel or panels. As will be seen, the enclosure typically has a cover having peripheral zipper connection to the enclosure, said cover in un-zipped and upwardly folded over condition defining the tray and a lower brace for the tray.

A further object is to provide a mounting bracket and an upright member extending upwardly through the bracket and connected to the stand below the bracket, for supporting the assembly.

Yet another object is to provide a method of readily accessing selected drumsticks, that includes:

i) providing an enclosure for transport of drumsticks and a stand, foldable structure attached to the enclosure having collapsed travel position relative to the enclosure, the structure having a deployed position in which the stand can be attached to the structure in upright supported position, and there being a generally horizontal tray associated with said structure in deployed position, ii) providing drumsticks on the tray, said drumsticks typically removed from the enclosure and displayed on the tray for selective use by a drummer, and at a level for drummer's easy access to the sticks, iii) and selectively using the displayed drum sticks.

The height of the stand may be adjusted to thereby adjust the height of the drumstick display tray, for ready accessing by the drummer.

These and other objects and advantages of the invention, as well as the details of an illustrative embodiment, will be more fully understood form the following specification and drawings, in which:

DRAWING DESCRIPTION

DETAILED DESCRIPTION

Figure 1:
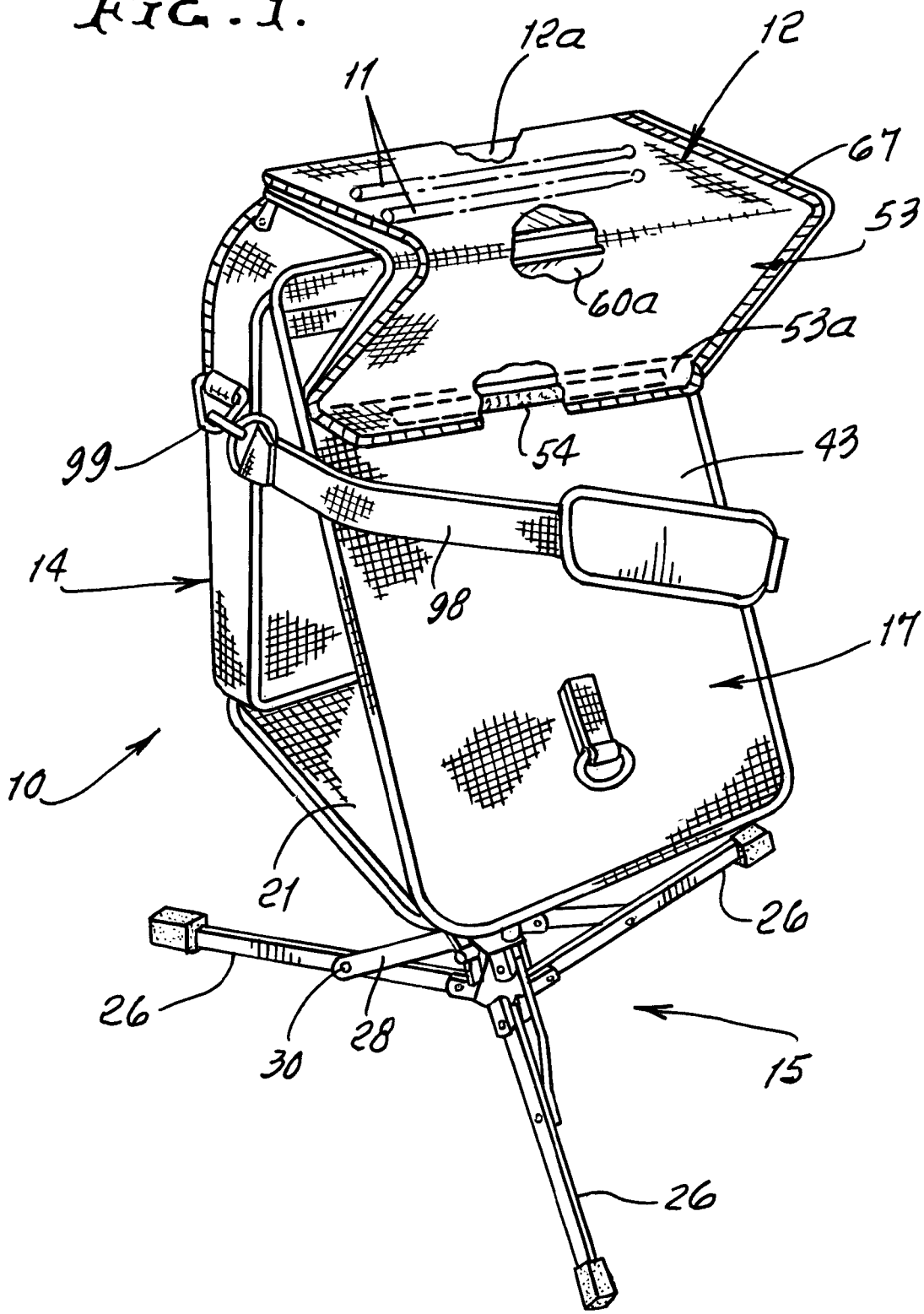
FIG. 1 is a frontal perspective view of apparatus embodying the invention.

In the drawings, and particularly in FIGS. 1-4, the deployed assembly 10 is adapted for display of multiple drumsticks 11, for easy access by a drummer who may be seated proximate the assembly 10, as during practice, or during a performance. See for example the top tray or panel 12 on which pairs of drumsticks are supported for easy access and selection.

Figure 8:
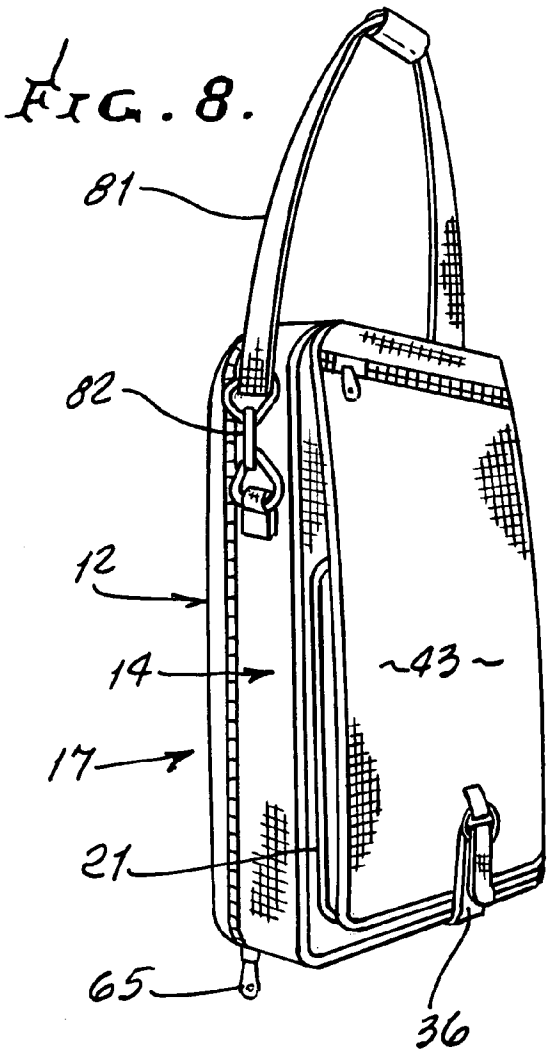
FIG. 8 is a perspective view of the FIG. 7 enclosure in closed, and upright condition, for transport.

Basically, the assembly 10 includes a luggage-like enclosure 14 for transport of the drumsticks and a collapsed stand 15 within the enclosure (see FIGS. 7 & 8); structure 17 attached to or associated with the enclosure, having a collapsed position relative to the enclosure for transport as seen in FIG. 8; that structure 17 having an alternative deployed position (see FIGS. 1-4) in which the stand 15 can be, or is, deployed and attached to the structure in upright supported position, and in which the panel or tray 12 is supported and extends generally horizontally. Note in FIG. 2 that the enclosure 14 assists in supported deployment of 17, with tray 12 extending generally horizontally for supporting the drumsticks.

Figure 2:
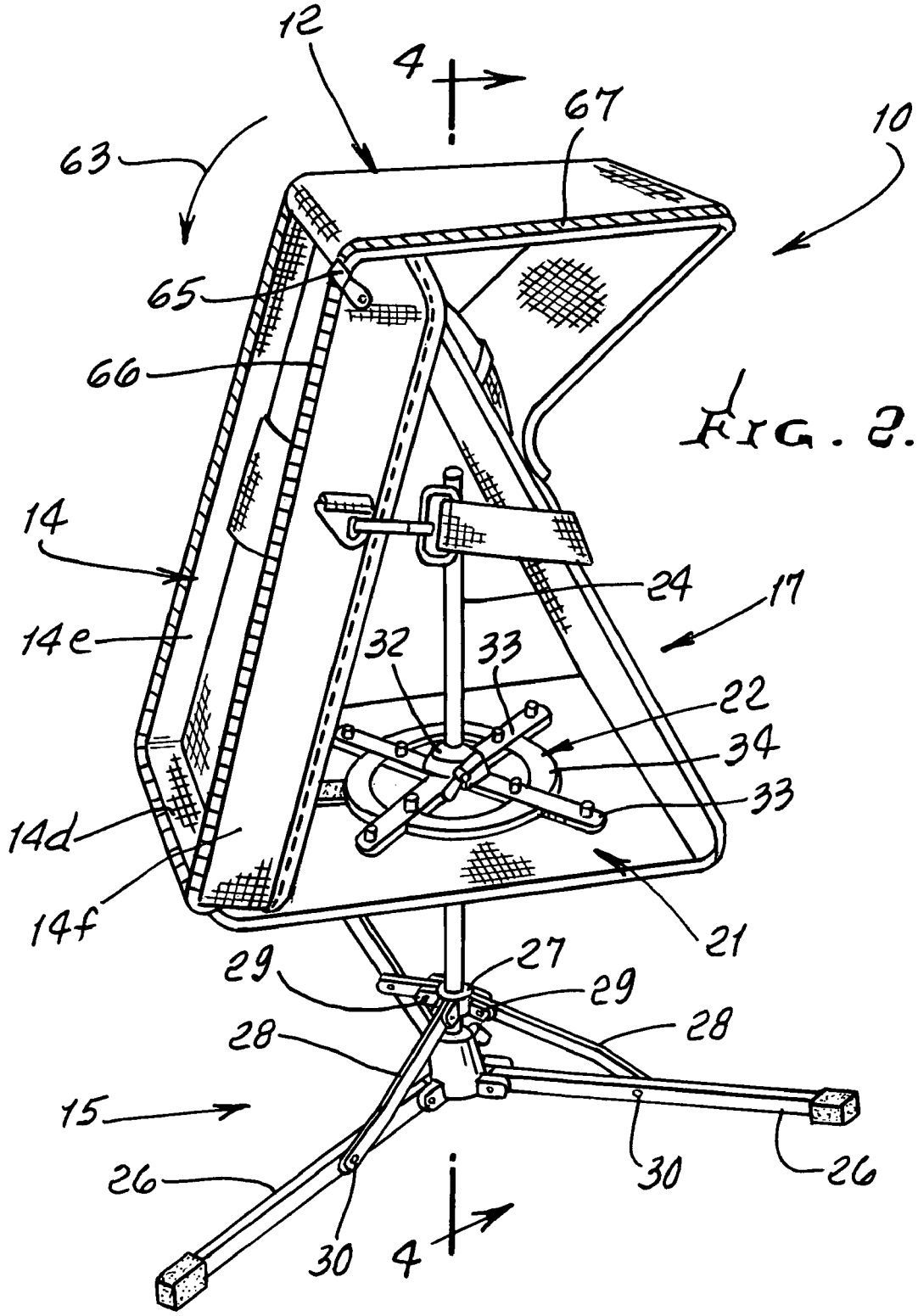
FIG. 2 is a side perspective view of the FIG. 1 apparatus.
Figure 3:
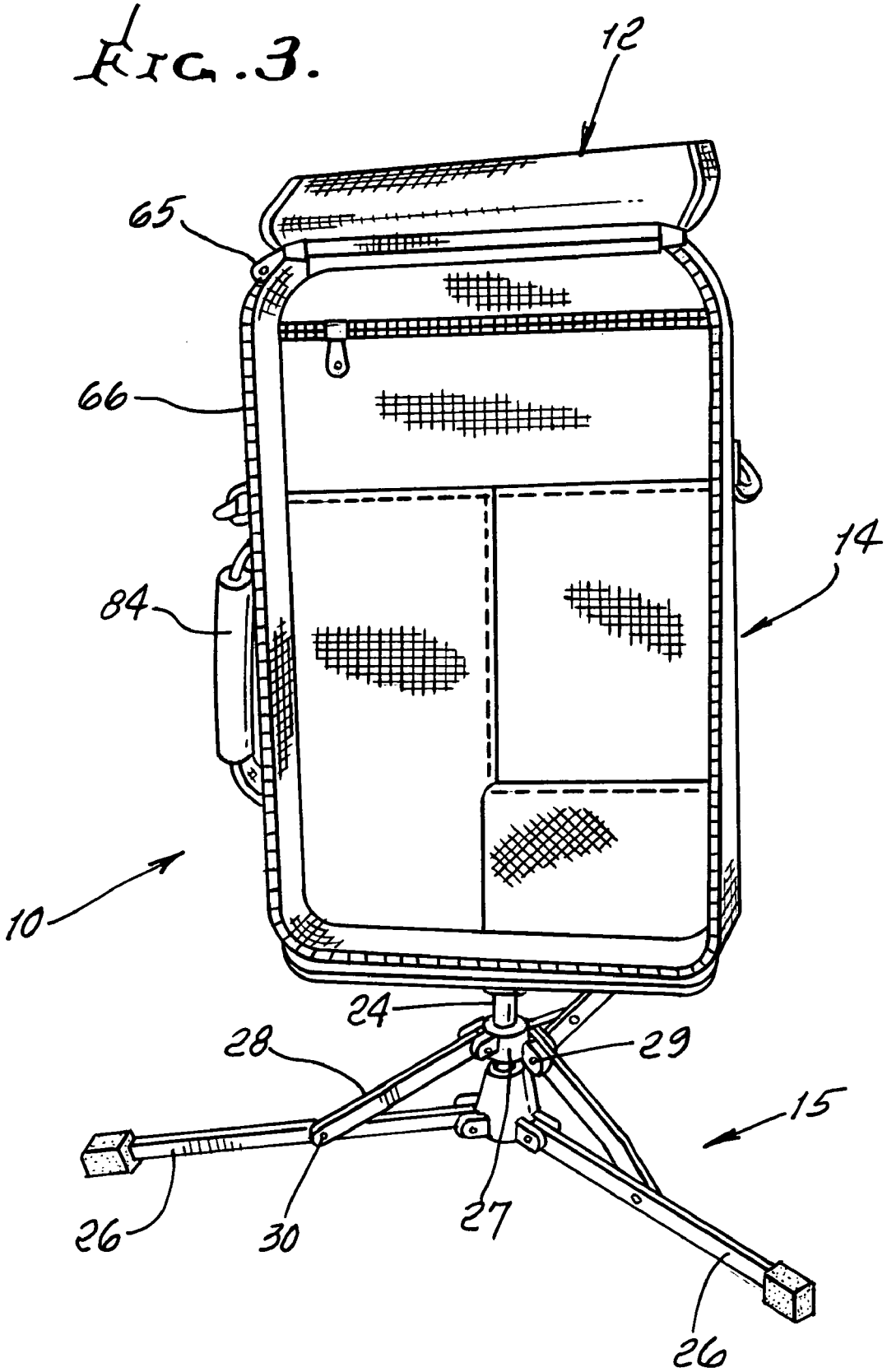
FIG. 3 is a rear view of the FIG. 1 and FIG. 2 apparatus showing the opened enclosure which assists in supporting the tray.
Figure 5:
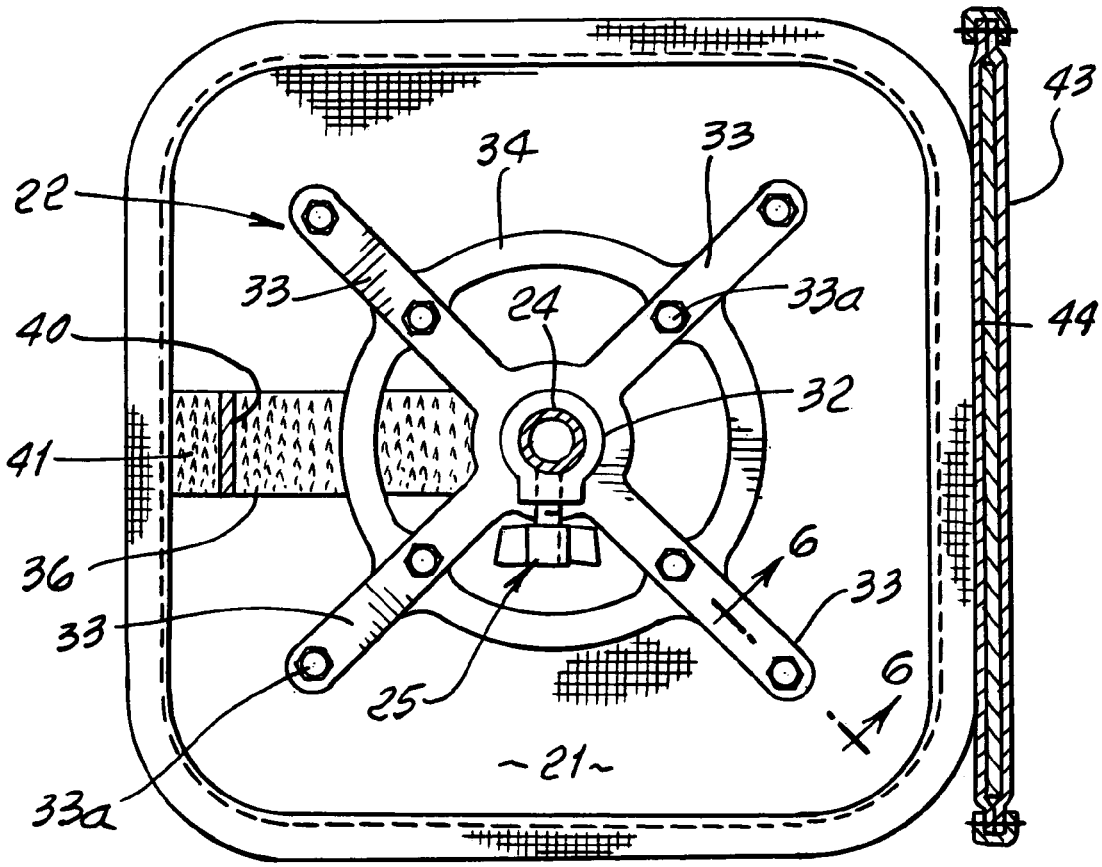
FIG. 5 is a plan view taken in section on lines 5-5 of FIG. 4.
Figure 6:
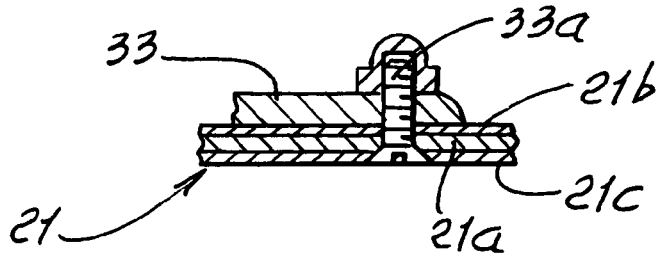
FIG. 6 is a fragmentary section taken on lines 6-6 of FIG. 5.

More specifically, the deployed structure 17 in FIG. 2 include a bottom panel 21 extending generally horizontally and connected to stand 15. The panel 21 carries a mounting bracket 22 defining a through opening 23 (see FIG. 4) that receives an upright post 24 of stand 15. An adjustable fastener 25 (see FIG. 5) can be tightened to attach the bracket to the post at selected height position. Post 24 is pivotally supported by stand legs 26; and their angled positions can be adjusted by adjusting the vertical position of a hub 27 on the post, to which links 28 are pivotally attached at 29. The links are also pivotally attached at 30 to the stand legs. Bracket 22 may include a hub 32 defining opening 23; cross members 33 attached to the hub; and a circular plate-like member 34 attached to members 33 and also attached to panel 21, for holding it in the position shown in FIGS. 2 and 4. FIGS. 5 and 6 show fastener attachment at 33*a* of a member 33 to panel 21. Panel 21 is shown as including a stiff sheet 21*a* and fabric layers 21*b* and 21*c* covering opposite sides of the sheet. A strap 36, attached to one end of the panel 21 at 37, is foldably or hingedly attached at 40 to an edge 14*a* of the enclosure 14. VELCRO 41 attaches the strap and the panel 21.

Structure 17 also includes upright panel 43, the lower end of which is pivotally attached at 44 to the opposite end of the panel 21. Panel 43 extends upwardly and convergently toward another edge 14*b* of the enclosure 14, edges 14*b* and 14*a* being at opposite ends of the enclosure base, for example at opposite ends of an enclosure base panel 46 comprising a stiff inner sheet 46*a* the opposite sides of which are covered by fabric layers 46*b* and 46*c*. The upper end of panel 43 has releasable attachment at 49 to the 14*b* of the edge enclosure 14.

One end 12*a*' of tray or panel 12 has pivotal and supported attachment at 50 to an end wall 51 of the enclosure 14. The opposite end 12*b*' of the tray is pivotally supported at 52 to a brace panel 53 extending downwardly and laterally toward panel 43. See FIG. 4. The lower end 53*a* of the brace has removable attachment at 54 to panel 43, as for example by VELCRO.

Figure 4:
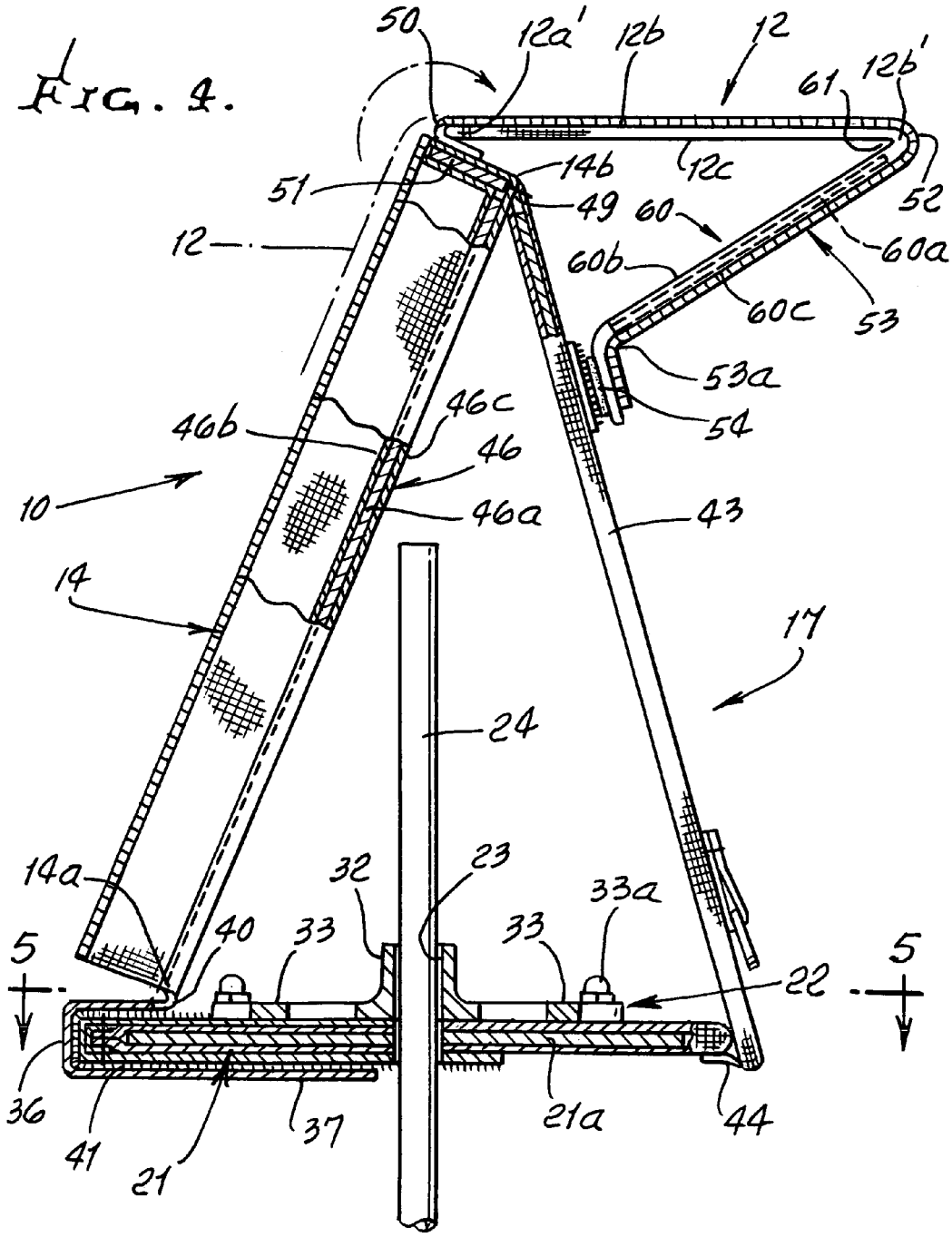
FIG. 4 is an enlarged sectional view taken on lines 4-4 of FIG. 2.

Referring to FIG. 4, the tray 12 extends generally horizontally, and has an extension 60 (i.e. brace 53) folded at 61 to extend downwardly and laterally toward panel 43 to be removably connected to that panel, as described, whereby extension 60 defines a lower brace for the tray. Connection 54 may comprise VELCRO, i.e. hook and pile material. In an alternate position, the tray and extension are swung counterclockwise see arrow 63 in FIG. 2, to provide a cover for the luggage like enclosure 14. In that position, the multi-function cover (i.e. tray and extension) may have zipper connection to the edges walls 14*d*, 14*e* and 14*f* of the enclosure 14. See zipper 65 and tracks 66 on walls 14*d*, 14*e* and 14*f* and tracks 67 on the tray edges, whereby a multi-function construction or assembly of elements is provided. See also FIGS. 7 and 8, whereby the collapsed stand 15 and the drumsticks can be easily stowed and transported in the luggage-like enclosure 14. Also, the panels 43 and 21 can easily be folded or collapsed to extend adjacent the enclosure bottom wall 46.

The wall 46, tray 12, and tray extension 60 may each consist of a stiff sheet 46*a*, 12*a* and 60*a*, and sheet fabric material at opposite sides of the sheet. See for example 46*b* and 46*c*, 12*b* and 12*c*, and 60*b* and 60*c*.

Figure 7:
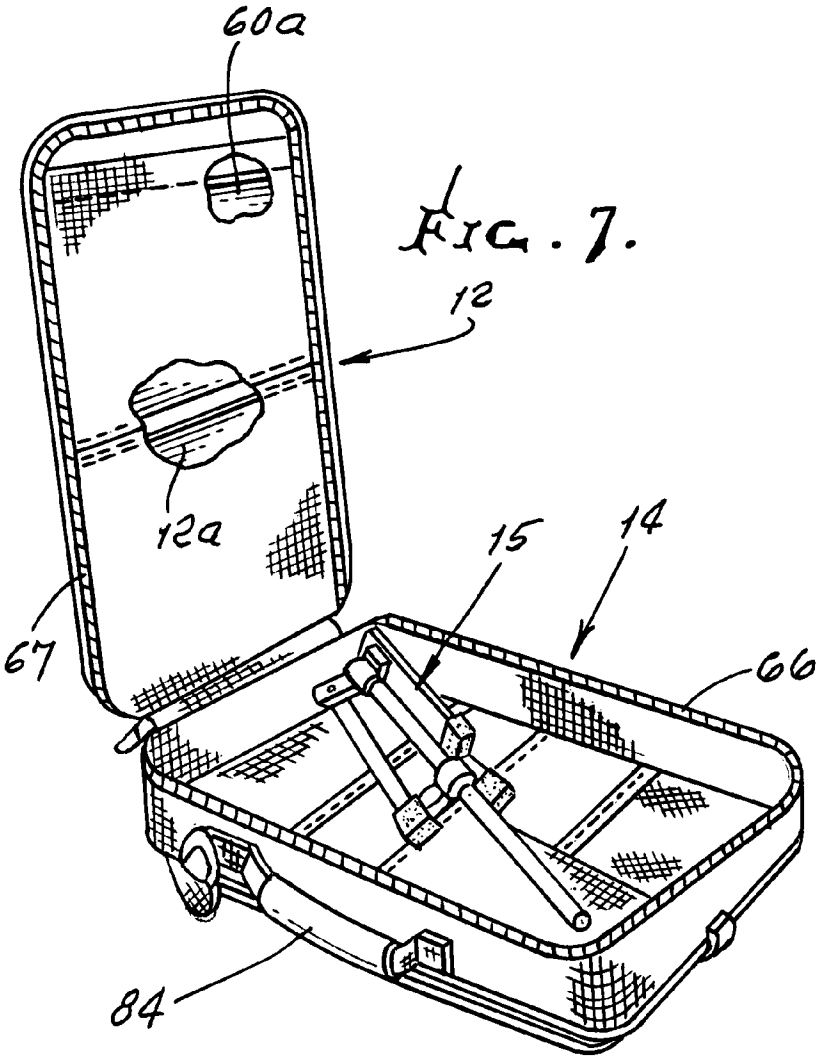
FIG. 7 is a perspective view of an open enclosure element of the invention.

FIGS. 7 and 8 show a strap handle 81 attached at 82 to the enclosure, to carry the collapsed enclosure, during transport. See also handle 84 strap 36 holds support panels to the bottom wall of the enclosure.

In FIG. 1, a releasable strap 98 holds the panel 43 in position, and is attached at 99 to the enclosure.

I claim:

1. An assembly for transporting and displaying multiple drumsticks for access, comprising, in combination:

a) an enclosure for transport of drumsticks and a stand, b) structure attached to the enclosure having collapsed position relative to the enclosure, for transport, c) said structure having an alternative deployed position in which the stand can be attached to said structure in upright supported position, d) there being a generally horizontal tray associated with said structure in said deployed position, e) the tray configured to support multiple drumsticks for selective use by a drummer, f) said stand attached to said structure via a structural support spaced below the level of said tray, in said deployed position, g) said structural support including a mounting bracket and an upright member extending upwardly through the bracket and connected to the stand below the bracket.

2. The combination of claim 1 wherein said tray and said structural support extend from the opened enclosure.

3. The combination of claim 1 wherein said structure includes a foldable first brace operatively connected to the structural support and the tray, and extending diagonally in space below the tray.

4. The combination of claim 1 wherein the tray has an alternate position defining a partial cover for the enclosure.

5. The combination of claim 2 wherein said structural support comprises a panel.

6. The combination of claim 3 wherein said brace comprises hingedly interconnected panels.

7. The combination of claim 3 wherein the enclosure has a cover with connection to the enclosure, said cover in opened and upwardly folded condition defining said tray and a lower brace for the tray.

8. The combination of claim 3 wherein the enclosure has a cover with edge connection to the enclosure, said cover in opened and upwardly folded condition defining said tray and a lower brace for the tray, said lower brace removably connected to said first brace.

9. An assembly for transporting and displaying multiple drumsticks for access, comprising, in combination:

a) an enclosure for transport of drumsticks and a stand, b) structure attached to the enclosure having collapsed position relative to the enclosure, for transport, c) said structure having an alternative deployed position in which the stand can be attached to said structure in upright supported position, d) there being a generally horizontal tray associated with said structure in said deployed position, e) the tray configured to support multiple drumsticks for selective use by a drummer, f) there being a stand attached to said structure via a structural support spaced below the level of said tray, in said deployed position, g) said structure including a foldable first brace operatively connected to the structural support and the tray, and extending diagonally in space below the tray, h) there being a strap operatively connected to the brace and said enclosure to hold the brace in diagonally extending position.

10. The method of readily accessing selected drum sticks, for use by a drummer, that includes i) providing an enclosure for transport of drum sticks and a stand, folding structure attached to the enclosure having collapsed travel position relative to the enclosure, said structure having a deployed position in which the stand can be attached to said structure in upright supported position, and there being a generally horizontal tray associated with said structure in said deployed position, ii) providing drum sticks on the tray, said drum sticks removed from the enclosure and displayed on the tray for selective use by a drummer, and at a level for drummer's easy access to the sticks, iii) and selectively using the displayed drum sticks iv) providing a foldable first brace operatively connected to the structural support and the tray, and extending diagonally in space below the tray, v) providing an extension of the tray folded to extend downwardly to be removably supported by said first brace, vi) said tray and extension having an alternate position in which they are removably connected to the enclosure to define a cover therefor.

11. The method of claim 10 including adjusting the height of said stand to thereby adjust the height of said tray.

12. The method of claim 10 including folding said structure into close travel position conformance with the enclosure, the stand collapsed and stowed in the enclosure.

* * * * *